US008286752B2

(12) United States Patent
McIntire et al.

(10) Patent No.: US 8,286,752 B2
(45) Date of Patent: Oct. 16, 2012

(54) ATTIC LADDER STRUT ATTACHMENT

(75) Inventors: Kevin McIntire, Stoneboro, PA (US); Thomas Ward Parker, Jamestown, PA (US)

(73) Assignee: Werner Co., Greenville, PA (US)

( * ) Notice: Subject to any disclaimer, the term of this patent is extended or adjusted under 35 U.S.C. 154(b) by 387 days.

(21) Appl. No.: 12/575,957

(22) Filed: Oct. 8, 2009

(65) Prior Publication Data

US 2010/0089695 A1 Apr. 15, 2010

Related U.S. Application Data

(60) Provisional application No. 61/103,753, filed on Oct. 8, 2008.

(51) Int. Cl.
*E06C 1/34* (2006.01)

(52) U.S. Cl. ..... 182/77; 182/78

(58) Field of Classification Search ..... 182/77–81; 248/200, 210, 238, 300, 235
See application file for complete search history.

(56) References Cited

U.S. PATENT DOCUMENTS

| | | | | | |
|---|---|---|---|---|---|
| 1,802,401 | A * | 4/1931 | Bessler | 182/79 |
| 2,496,773 | A * | 2/1950 | Brown | 182/78 |
| 2,580,978 | A * | 1/1952 | Triller | 182/80 |
| 2,649,237 | A * | 8/1953 | Bjorklund et al. | 182/78 |
| 2,852,176 | A * | 9/1958 | Harmon | 182/78 |
| 2,945,548 | A * | 7/1960 | Tapp | 182/77 |
| 3,051,261 | A * | 8/1962 | Webb, Sr. et al. | 182/78 |
| 3,901,353 | A * | 8/1975 | Skolnik | 182/78 |
| 4,155,422 | A | 5/1979 | Larson et al. | |
| 4,281,743 | A | 8/1981 | Fuller | |
| 4,541,508 | A * | 9/1985 | Lundh | 182/78 |
| 4,899,420 | A * | 2/1990 | Bye et al. | 16/16 |
| 5,033,134 | A * | 7/1991 | Burchett | 5/133 |
| 6,212,827 | B1 * | 4/2001 | Miller | 49/345 |
| 6,991,063 | B2 | 1/2006 | Latimer et al. | |
| 7,165,649 | B2 * | 1/2007 | Latimer et al. | 182/77 |
| 2003/0075656 | A1 | 4/2003 | Muir | |
| 2005/0029042 | A1 | 2/2005 | Latimer et al. | |
| 2008/0179137 | A1 | 7/2008 | Latimer et al. | |

OTHER PUBLICATIONS

International Search Report and Written Opinion issued in International Patent Application No. PCT/US2009/060025, mailed Dec. 4, 2009.

International Preliminary Report issued in International Application No. PCT/US09/60025, mailed Oct. 20, 2010.

* cited by examiner

*Primary Examiner* — Katherine W Mitchell
*Assistant Examiner* — Daniel Cahn
(74) *Attorney, Agent, or Firm* — McDermott Will & Emery LLP

(57) ABSTRACT

A folding ladder assembly having a door, a frame, and a strut connecting the door and frame. The strut comprises a first end and a second end opposite the first end. The first end of the strut is attached to the door via a strut stop bracket. The other end of the strut is attached to a stationary mounting plate, which is attached to the ladder opening frame. The strut is attached to the strut bracket via a strut standoff using an E-clip retaining ring. Optionally, the strut standoffs are riveted to the strut stop bracket and the stationary mounting plate. The strut stop bracket is optionally formed having a double bend to form two substantially parallel portions connected by a third non-parallel portion.

6 Claims, 7 Drawing Sheets

ATTIC LADDER STRUT ATTACHMENT

CROSS REFERENCE TO PROVISIONAL APPLICATION

This application is based upon and claims the benefit of priority from Provisional U.S. Patent Application 61/103,753 filed on Oct. 8, 2008, the entire contents of which are incorporated by reference herein.

TECHNICAL FIELD

The present disclosure relates to foldable ladders. The present disclosure has particular applicability to strut attachments for use in foldable ladders.

BACKGROUND

Attic ladders are used for the purpose of granting access to areas above or below a room or floor in which limited space is available. One key feature of the attic ladder is its ability to fold or retract upward into the ceiling in order to take up no floor space except when extended. Other advantages to the use of foldable attic ladders are the low cost and ease of manufacturing relative to typical fixed stairways. A key part of a foldable ladder is a strut. A strut is used to counteract the weight of a foldable ladder. Some foldable ladders are installed in an opening in a ceiling and are stowable above the ceiling. Typically, the stowed ladder is pulled down from the ceiling.

Examples of attic ladders or "disappearing stairways" are shown, for example, in U.S. Pat. Nos. 2,649,237 and 2,852,176. These ladders normally fold and retract upwardly into a frame secured between adjacent joists of the attic, and the folded ladder is covered by a door which normally extends substantially flush with the finished ceiling of the room in which the ladder is mounted.

The use of struts, such as a gas strut, in an attic ladder assembly permits single person installation of the attic ladder. In previous designs, one end of the strut is attached to the attic ladder while the other end is attached to a moveable lever arm attached to the upper section of the attic ladder. Attic ladders according to the present disclosure simplify ladder installation and reduce the cost and complexity of ladder for the manufacturer.

U.S. Pat. No. 4,281,743 shows another conventional attic ladder. As shown in FIGS. 1A and 1B, attic ladder 111 includes an outside frame 112 mounted between adjacent floor joists 113 of the attic floor 114. Cross braces 115 are mounted between a pair of adjacent floor joists 113 to provide end support for the frame 112 of the ladder. Ladder 111 is mounted in the ceiling by securing frame 112 to the joists 113 and the cross braces 115. A cover panel 116 forms part of ladder 111 and is hinged to the outer frame 112, so that the door becomes substantially flush with the ceiling 119 when the ladder 111 is folded. A first ladder portion 117 is affixed to the inner face of cover panel 116 and a second ladder portion 118 is pivotally hinged to the first ladder portion so as to be unfolded or folded when the ladder is opened or closed. While commercially available attic ladders or disappearing stairways typically come in a number of sizes, most come in several standard widths and lengths adaptable to fit conventional constructions.

U.S. Pat. No. 4,541,508 shows yet another conventional attic ladder. In FIG. 2, a foldable ladder is shown to consist of a lower section 211, a central section 212 and an upper section 213. The central section 212 is hingedly connected to the two remaining sections 211, 213 by a hinge so that the central section 212 and the lower section 211 can be folded up on the upper section 213. Upper section 213 is hingedly attached to a frame 214 by hinges 215, with the folding down movement of the upper ladder section 213 being limited by a pair of toggle joints 216 attached to the upper ladder section and to the frame 214. Toggle joints 216 are rigidly connected to each other at the lower arms by means of an axle 218 extending in parallel with the rungs of the ladder and are attached to the axle outside the side rails of the ladder. The ladder is spring-biased to a closed position by a gas spring 219 connected at one end to an outside of one side rail and connected at its other end, via piston rod 219*a*, to moment arm 218*a*, which is rigidly connected to the axle 218 at such an angle that a maximum moment is generated when the door is almost entirely closed. When the point of connection between the gas spring 219 and the moment arm 218*a* has passed the line for moment center (i.e. the connecting line between the attachment of the gas spring 219 to the ladder 213 and the axle 218, which passing takes place when the door is opened entirely), the gas spring 219 actuates the door so that it is locked in folded-down position, which is necessary because the "weight" of the door decreases as soon as the ladder sections are folded out.

SUMMARY

To overcome the above and additional problems, foldable ladders according to the present disclosure have fewer moving parts than previous leaders. In certain embodiments, a folding ladder assembly comprises a door, a frame, and a strut connecting the door and frame. Unlike previous attic ladders having struts, in which the strut is attached to an independently moveable lever arm, the struts in the present disclosure are attached to a strut stop bracket. The strut comprises a first end and a second end opposite said first end. The first end of the strut is attached to the door via the strut stop bracket. Optionally, the strut stop bracket is attached to the door portion of a foldable ladder. The other end of the strut is attached to a stationary mounting plate, which is attached to the ladder opening frame. In certain embodiments, the strut is attached to the strut bracket using an E-clip retaining ring. Optionally, the strut is attached to the strut bracket via a strut standoff using an E-clip retaining ring. In other embodiments, the strut standoffs are riveted to the strut stop bracket and the stationary mounting plate. Typically, the strut is a gas strut.

The E-clip retaining ring simplifies installation of the strut to the strut bracket. The E-clip retaining ring is snapped into place securing the strut to the strut standoff. In conventional foldable ladders, nut and bolt attachments tend to loosen, and need frequent retightening. In contrast, the present disclosure features struts that are secured to the strut standoffs using the E-clips.

In another embodiment of the present disclosure, the strut stop bracket has a bend in a vertical portion such that the strut stop bracket has a biplanar structure having a first substantially planar portion and a second substantially planar portion parallel to the first planar portion. The first and second planar portions are connected by a third substantially planar portion not parallel to the first and second portions. This bend allows for increased strength, as well as maintaining the strut in proper alignment.

Additional advantages and other features of the present disclosure will be set forth in part in the description which follows and in part will become apparent to those having ordinary skill in the art upon examination of the following or may be learned from the practice of the disclosure. The advantages of the disclosure may be realized and obtained as particularly pointed out in the appended claims.

As will be realized, the present disclosure is capable of other and different embodiments, and its several details are capable of modifications in various obvious respects, all without departing from the disclosure. Accordingly, the drawings and description are to be regarded as illustrative in nature, and not as restrictive.

BRIEF DESCRIPTION OF THE DRAWINGS

Reference is made to the attached drawings, wherein elements having the same reference numeral designations represent like elements throughout, and wherein.

DETAILED DESCRIPTION

Figure 1B:
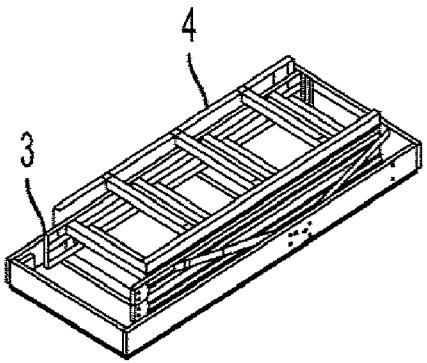
FIG. 1A-1B are perspective views of a frame and strut assembly according to one embodiment of the present disclosure.
Figure 1A:
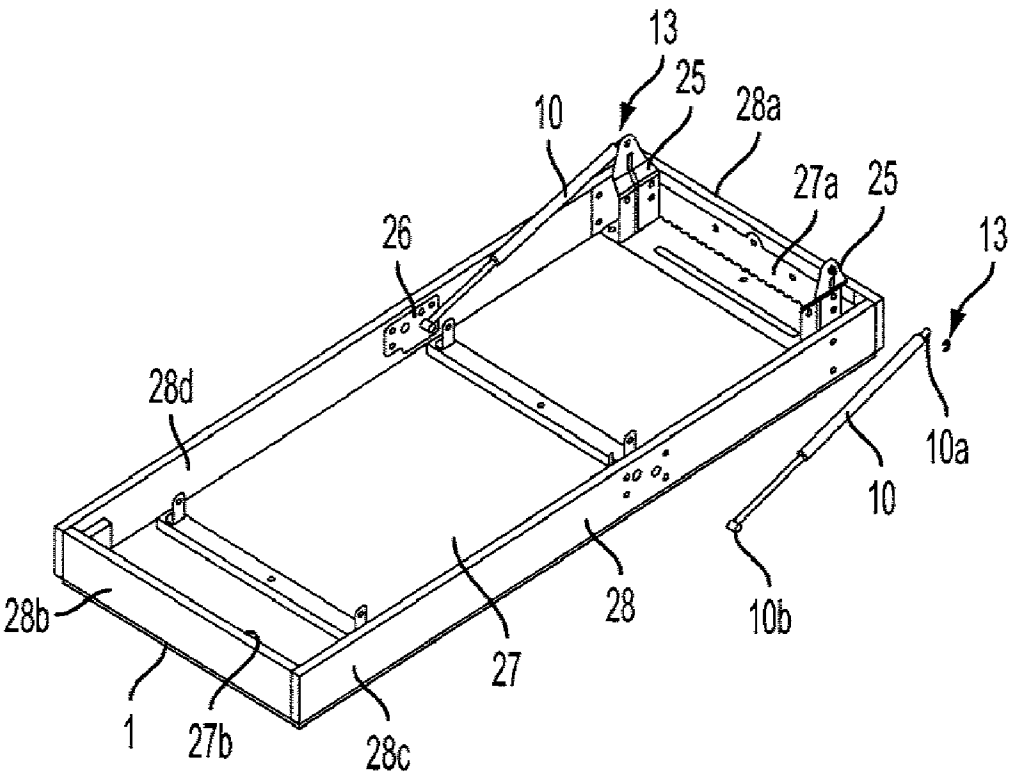

An embodiment of the folding ladder according to the present disclosure is illustrated in FIGS. 1-5. The folding ladder assembly 1 comprises a door 27, a frame 28 and a strut 10 connecting the door 27 and frame 28. The strut 10 comprises a first end 10*a* and a second end 10*b* opposite said first end 10*a*. The strut 10 is attached to a strut stop bracket 25 on the first end 10*a*, and a side board mounting plate 26 is attached to the second end of the strut 10*b*. The strut stop bracket 25 is attached to the door 27, and the side board mounting plate 26 is attached to the frame 28 of the door and frame assembly 1. The stop bracket 25 can be attached to the door 27 via screws or nails, or any other way known in the art to affix a metal piece to wood can be used.

Figure 2:
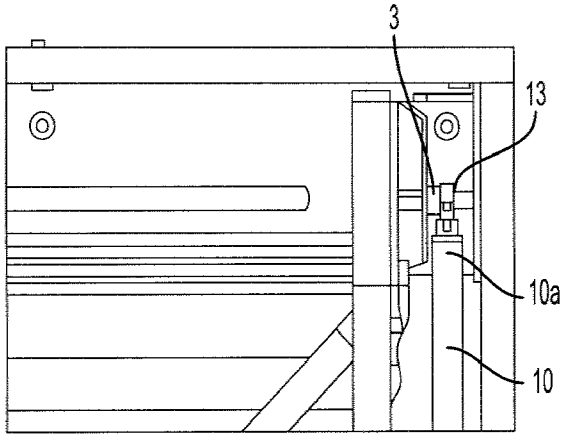
FIG. 2 is a top view detail drawing of the upper portion of the attached strut of FIG. 1A.
Figure 3:
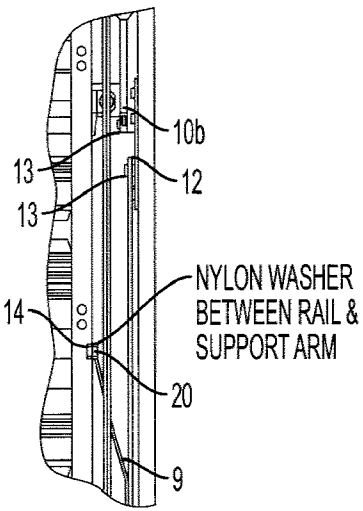
FIG. 3 is a top view detail drawing of the lower portion of the attached strut of FIG. 1A.

The side board mounting plate 26 is stationary, while the strut stop bracket 25 rotates with the door 27 but is stationary relative to the door 27. As with the stop bracket 25, the mounting plate 26 may be attached to the frame 28 in any suitable way known in the art, such as by screw or nail. As can be seen in FIGS. 2, 3 and 4B the strut 10 fits in between the frame 28 and the ladder 100.

FIG. 2 shows a detailed view of the first end of the strut 10*a* attached to the strut stop bracket 25 via an E-clip 13. As is shown, the first end of the strut 10*a* is mounted on the strut stop bracket 25 and securely attaches the strut 10 to a strut standoff 3. The E-clip secures the strut 10 to the strut standoff 3. FIG. 3 is a view of the second end of the strut 10*b* similarly attached to the mounting plate 26 via an E-clip 13.

Figure 4C:
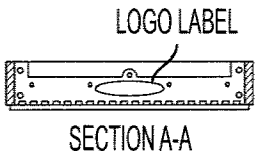
FIG. 4A-4C are side, edge and plan views of a frame and strut assembly according to one embodiment of the present disclosure.
Figure 4B:
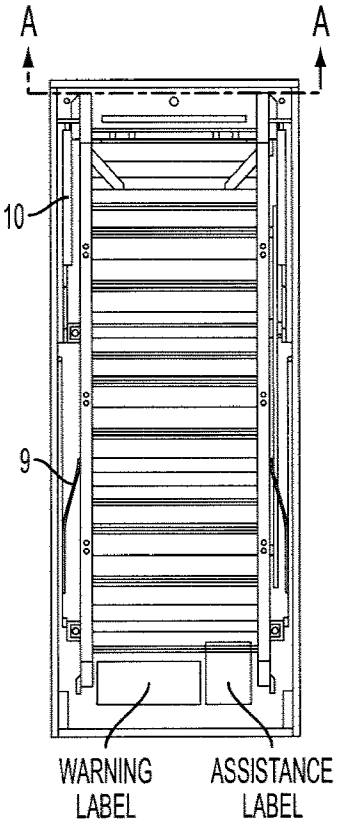
Figure 4A:
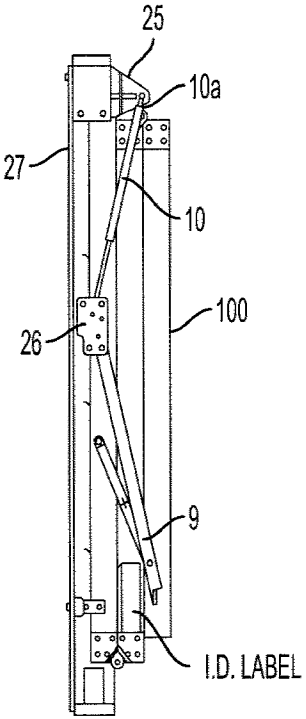

FIGS. 4A-C show how the relationship between the ladder 100 of the folding ladder assembly 1 and the struts 10. As is shown in FIG. 4B, the ladder 100 fits between the two struts 10 so that the ladder can unfold from the assembly without interfering with the strut operation. The ladder unfolds via the support arm assembly 9.

Figure 5A:
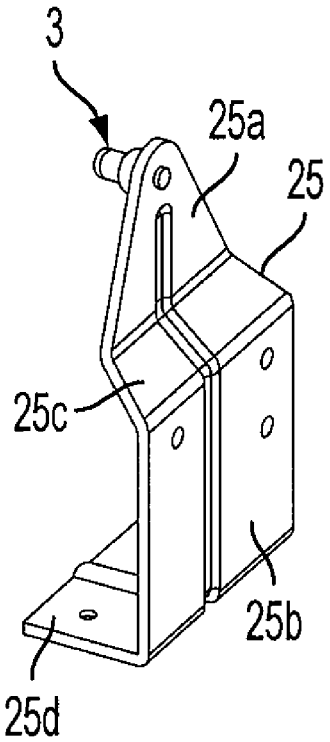
FIG. 5A-5B are representations of the strut stop bracket of an embodiment of the present disclosure.
Figure 5B:
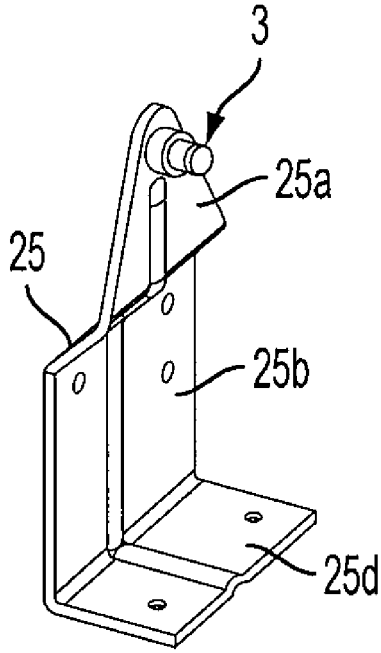

Detailed views of a left hand and right hand strut stop bracket 25 according to a certain embodiment of the present disclosure, are shown in FIG. 5. The strut 10 (not shown) can be attached to the strut stop bracket 25 via a strut standoff 3. The strut stop bracket has a bend in a extended portion of the strut standoff bracket 25. As is shown, the strut standoff bracket 25 has a first portion 25*a*, a second portion 25*b* substantially parallel to the first portion 25*a*, and a third portion 25*c* connecting the first and second portions 25*a*, 25*b*. The third portion 25*c* extends away from the strut 10 such that the second portion 25*b* is laterally spaced further apart from the strut than the first portion 25*a*. This bent structure helps maintain the strut 10 in proper alignment, when opening and closing the door 27. The strut stop bracket 25 further has a fourth portion 25*d* connected to the second portion 25*b*, wherein the fourth portion 25*d* extends substantially orthogonal to said second portion 25*b* toward said strut 10, and said fourth portion 25*d* is connected to said door 27.

Figure 6D:
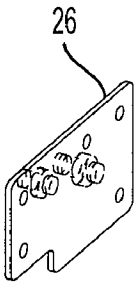
FIGS. 6A-6D are side views of the side board mounting plate with the short standoff and strut standoff of an embodiment of the present disclosure.
Figure 6C:
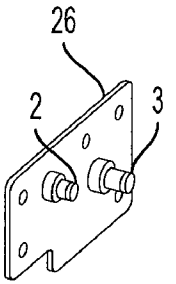
Figure 6B:
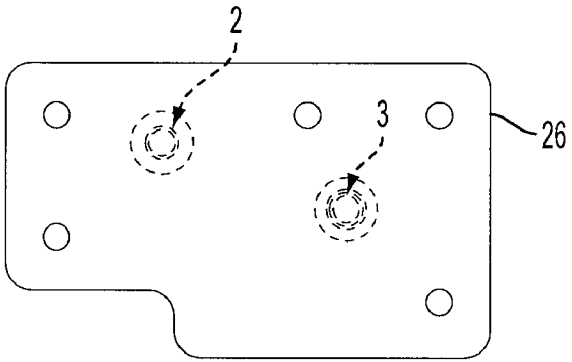
Figure 6A:
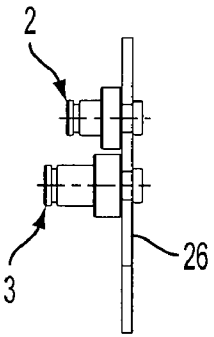

Detailed views of the side board mounting plate 26 are shown in FIGS. 6A-6D. The strut standoff 3 and a short standoff 2 are riveted to the side board mounting plate 26. As can be seen in FIG. 6A, the strut standoff 3 extends a greater distance from the mounting plate than the short standoff 2. This allows for correct positioning of the strut 10 and support arm assembly 9 without unwanted overlap. Furthermore, FIG. 6B shows how the short standoff 2 is positioned above the strut standoff with respect to the long edge of the mounting plate 26 to ensure that the strut 10 and support arm assembly 9 are positioned with sufficient space to avoid overlap.

Figure 7A:
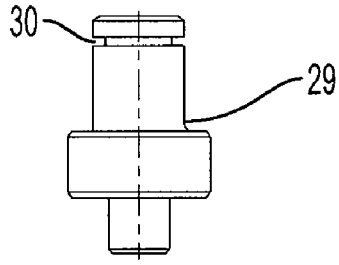
FIGS. 7A-7C are side and perspective views of the strut standoff of an embodiment of the present disclosure.
Figure 7B:
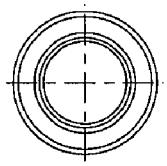
Figure 7C:
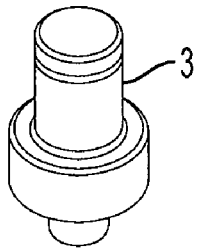
Figure 8A:
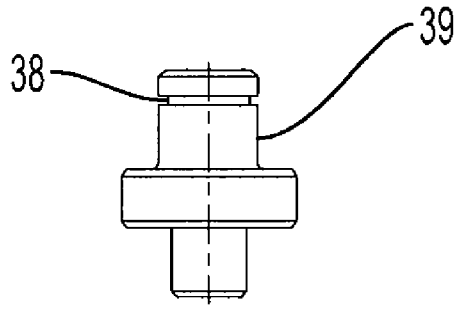
FIGS. 8A-8C are side and perspective views of the short standoff of an embodiment of the present disclosure.
Figure 8B:
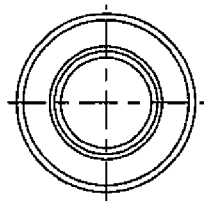
Figure 8C:
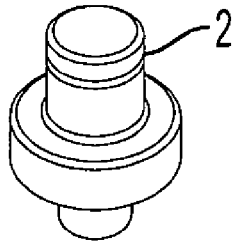

Optionally, the strut standoff 3 is riveted to the strut standoff bracket 25. A detailed view of the strut standoff 3 is shown in FIGS. 7A-C. As is shown, the strut standoff 3 has a recess 30 in the main body portion 29 of the strut standoff 3. This recess allow for the secure attachment of the strut 10 to the strut standoff A detailed view of the short standoff 2 is shown in FIGS. 8A-C. Similarly to the strut standoff, the short standoff 2 has a recess 38 in the main body portion 39 of the short standoff 2. This recess allow for the secure attachment of a support arm assembly 9 (see FIG. 1), which stabilizes the ladder, to the short standoff 2.

Figure 9B:
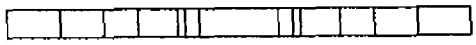
FIGS. 9A-9C are side and perspective views of the E-clip of an embodiment of the present disclosure.
Figure 9C:
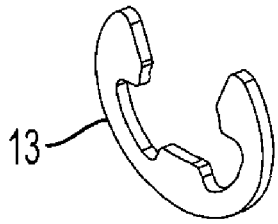
Figure 9A:
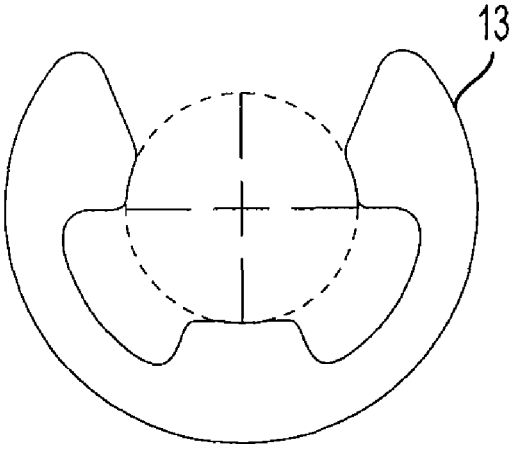

FIG. 9 shows detailed views of the E-clip retaining ring 13 used to secure the attachment of the gas strut 10 to the strut standoffs 3. The E-clip retaining ring 13 is positioned around a recess 30 of the strut standoff 3 to securely hold the gas strut 10 on a main body portion 29 of the strut standoff 3. The E-clip 13 has semi-flexible ridges to allow for the E-clip 13 to snap onto the strut standoff 3 via the recess 30, but have sufficient rigidity to prevent easy removal of the E-clip 13 from the strut standoff 3.

According to a certain embodiment of the present disclosure, an attic ladder assembly 1 is provided comprising a foldable ladder 100 attached to a door 27. The door 27 has an upper end 27*a* and an opposing lower end 27*b*. One or more strut stop brackets 25 are attached to the upper end of the door 27. A strut 10 is attached to the strut stop bracket 25.

Optionally, the attic ladder and frame assembly 1 also has a ceiling frame 28. The frame comprises a front end 28*a*, a rear end 28*b* opposing the front end, and opposing lateral sides 28*c*, 28*d* connected to the front and rear ends. The foldable ladder 100 is attached to the door 28. The upper end 27*a* of the door is attached to the rear end of the frame 28*b* via a hinge. One or more strut stop brackets 25 are attached to the upper end of the door 27*a*. A first end of a strut 10*a* is attached to the strut stop bracket 25. The frame 28 has at least one side board mounting plate 26 fixedly attached to a lateral side of the frame 28. A second end of the strut 10*b*, opposing the first end of the strut 10*a*, is attached to the side board mounting plate 26.

In certain embodiments of the present disclosure, the strut is a gas strut.

The present disclosure can be practiced by employing conventional materials, methodology and equipment. Accordingly, the details of such materials, equipment and methodology are not set forth herein in detail. In the previous descriptions, numerous specific details are set forth, such as specific materials, structures, chemicals, processes, etc., in order to provide a thorough understanding of the disclosure. However, it should be recognized that the present disclosure can be practiced without resorting to the details specifically set forth. In other instances, well known processing structures have not been described in detail, in order not to unnecessarily obscure the present disclosure.

What is claimed is:

1. A folding assembly comprising:

a door;

a foldable ladder attached to said door;

a frame;

a strut connecting the door and frame, wherein said strut comprises a first end and a second end opposite said first end, wherein said first end of said strut is attached to said door via a strut stop bracket, wherein said second end of said strut is attached to said frame via a mounting plate, wherein the strut stop bracket comprises a strut standoff, and said strut is attached to said strut stop bracket via the strut standoff and an E-clip retaining ring secures said strut to said strut standoff, and wherein the strut stop bracket comprises a first portion, wherein said strut standoff is attached to said first portion, a second portion substantially parallel to the first portion, and a third portion connecting the first portion and the second portion, wherein the third portion extends away from the strut such that the second portion is laterally spaced further apart from the strut than the first portion, and a fourth portion connected to the second portion, wherein the fourth portion extends substantially orthogonal to said second portion toward said strut, and said fourth portion is connected to said door.

2. The folding assembly according to claim wherein said assembly further comprises a second strut standoff riveted to the mounting plate, wherein said strut is attached to mounting plate via said second strut standoff.

3. The folding assembly according to claim 1, wherein said strut is a gas strut.

4. The folding assembly according to claim 1, wherein the folding assembly is an attic ladder assembly.

5. The folding assembly according to claim 1, wherein said first, second and fourth portions are substantially planar.

6. The folding assembly according to claim 1, wherein said door said strut standoff is a rivet.

* * * * *